US012690702B2

(12) United States Patent
Lee

(10) Patent No.: US 12,690,702 B2
(45) Date of Patent: Jul. 28, 2026

(54) COVER FOR CUSHION

(71) Applicant: RUBETTY INC., Seoul (KR)

(72) Inventor: Ha Na Lee, Seoul (KR)

(73) Assignee: RUBETTY INC., Seoul (KR)

( * ) Notice: Subject to any disclaimer, the term of this patent is extended or adjusted under 35 U.S.C. 154(b) by 0 days.

(21) Appl. No.: 19/148,007

(22) PCT Filed: Jan. 12, 2024

(86) PCT No.: PCT/KR2024/000634
§ 371 (c)(1),
(2) Date: Jul. 15, 2025

(87) PCT Pub. No.: WO2024/155034
PCT Pub. Date: Jul. 25, 2024

(65) Prior Publication Data

US 2026/0108085 A1 Apr. 23, 2026

(30) Foreign Application Priority Data

Jan. 16, 2023 (KR) ..... 10-2023-0006041

(51) Int. Cl.
*A47G 9/02* (2006.01)

(52) U.S. Cl.
CPC ..... *A47G 9/0253* (2013.01)

(58) Field of Classification Search
CPC ..... A47G 9/0253; A47G 9/0261; A47G 9/10; A47G 2009/0269
See application file for complete search history.

(56) References Cited

U.S. PATENT DOCUMENTS 1,269,276 A * 6/1918 Harris ..... A47G 9/0253 5/639
4,177,806 A * 12/1979 Griffin ..... A61F 13/062 128/892
5,685,613 A * 11/1997 Franzen, Jr. ..... A47G 9/10 297/DIG. 6
7,627,916 B1 * 12/2009 Gielow ..... A47C 16/00 5/636

(Continued)

FOREIGN PATENT DOCUMENTS

CN 209574188 U 11/2019
CN 210930626 U 7/2020

(Continued)

*Primary Examiner* — George Sun
(74) *Attorney, Agent, or Firm* — NKL LAW; Jae Youn Kim

(57) ABSTRACT

A cover for cushion, which is covered on a cushion, comprises a body portion having a predetermined area, a pair of vertical edge portions formed along left and right edges of the body portion, respectively, a pair of horizontal edge portions formed along upper and lower edges of the body portion, respectively, and a pair of connecting portions formed to mutually connect both ends of the vertical edge portions, respectively. The connecting portions comprises a pair of first connecting portions respectively formed to extend from upper ends of the vertical edge portions, and a pair of second connecting portions respectively formed to extend from lower ends of the vertical edge portions and correspondingly coupled to the first connecting portions.

11 Claims, 18 Drawing Sheets

(56) References Cited

U.S. PATENT DOCUMENTS

| | | | | |
|---|---|---|---|---|
| 8,327,483 | B1 * | 12/2012 | Zamora | A47G 9/10 5/636 |
| 8,347,431 | B1 * | 1/2013 | Cohron, III | A47G 9/0253 5/489 |
| 2006/0213012 | A1 * | 9/2006 | Nakasato | A47G 9/10 5/636 |
| 2010/0269259 | A1 * | 10/2010 | Campbell | A47C 21/022 5/498 |
| 2011/0272981 | A1 * | 11/2011 | Rabson | A47C 31/113 297/219.1 |
| 2016/0296046 | A1 * | 10/2016 | Jurado | A47G 9/0253 |
| 2017/0150835 | A1 * | 6/2017 | Siebje | A47G 9/0253 |
| 2018/0303257 | A1 * | 10/2018 | Alletto, Jr. | A47G 9/0253 |
| 2020/0146475 | A1 * | 5/2020 | Sherry | A47G 9/1027 |
| 2021/0030160 | A1 * | 2/2021 | Porter | A61F 9/04 |
| 2021/0321799 | A1 * | 10/2021 | Wakeham | A47G 9/0253 |
| 2024/0057780 | A1 * | 2/2024 | Visitacion | A47C 21/022 |

FOREIGN PATENT DOCUMENTS

| | | | |
|---|---|---|---|
| CN | 211748537 | U | 10/2020 |
| JP | 3104705 | U | 10/2004 |
| JP | 2010-227384 | A | 10/2010 |
| JP | 3176287 | U | 6/2012 |
| KR | 10-2231157 | B1 | 3/2021 |
| KR | 10-2404253 | B1 | 6/2022 |

* cited by examiner

COVER FOR CUSHION

TECHNICAL FIELD

The present invention relates to a cover for cushion used by covering cushions such as pillows, seat cushions, or backrests.

BACKGROUND ART

Generally, pillows, seat cushions, and backrests are made of cushioning materials capable of elastic deformation to absorb impacts, and the exterior surfaces thereof are protected by covers. Such cushions provide support for body parts like the head, neck, hips, back, or waist when users take a rest, and various types have been introduced to the market, ranging from those for human use to those intended for pets.

When using a cushion, the user's body parts come into contact with it, which can lead to contamination of the cover surrounding the cushion. Particularly during summer, the cover often becomes soiled due to secretions such as sweat. However, cushions are generally composed of foam materials having numerous fine spaces, which make thorough drying difficult. Furthermore, due to the considerable bulk thereof, it is challenging to wash cushions using conventional washing machines. Accordingly, detachable covers configured for easy attachment to and removal from one side of the cushion have recently been employed.

However, conventional cover for cushions tend to slip off due to user movement during actual use, thereby failing to properly perform the intended protective function thereof. Additionally, there is an inconvenience in that separate fastening members corresponding to the cushion must be provided to prevent such slippage. Further, when the size of the cushion changes, an additional separate cover must be purchased accordingly. When the size of the cover does not match the cushion, the cushion may slip out of the cover, or the shape thereof may deform, thereby reducing usability.

Meanwhile, as prior art documents related to cover for cushions, JP 2010-227384 A discloses a pillow cover having a connecting structure, CN 210930626 U discloses a pillow cover having a connecting structure, US 2021/0321799 A discloses a pillow case provided with an elastic cord assembly, KR 10-2231157 B discloses a pillow cover into which tightening straps equipped with buckles are inserted, US 2010/0269259 A discloses a pillow cover having an extension part forming a hook set as an adjustment means, CN 209574188 U discloses a pillow cover through which rope rings are inserted, CN 211748537 U discloses a pillow cover having stitch lines dividing the pillow area, and KR 10-2404253 B discloses a blanket provided with fabric for covering stitch lines.

However, the covers according to the above prior arts have problems in that the cushion is not firmly fixed, causing frequent unintended separation of the cover from the cushion during use. Additionally, covers utilizing hooks have the disadvantage of damaging other laundry items due to the hooks during washing.

DETAILED DESCRIPTION OF THE INVENTION

Technical Problem

It is an object of the present invention to provide a cover for cushion capable of being easily coupled to and separated from a cushion, and securely coupled thereto, thereby preventing unintended separation of the cushion from the cover.

It is another object of the present invention to provide a cover for cushion that does not cause deformation or damage to other laundry items during washing.

It is another object of the present invention to provide a cover for cushion whose size is adjustable according to the dimensions of the cushion.

It is another object of the present invention to provide a cover for cushion having an aesthetically pleasing appearance when fitted onto a cushion.

Technical Solution

In accordance with one aspect of the present invention, provided is a cover for cushion including a body portion having a predetermined area, a pair of vertical edge portions formed along left and right edges of the body portion, respectively, a pair of horizontal edge portions formed along upper and lower edges of the body portion, respectively, and a pair of connecting portions formed to mutually connect both ends of the vertical edge portions, respectively.

According to one aspect, the connecting portions may include a pair of first connecting portions respectively formed to extend from upper ends of the vertical edge portions, and a pair of second connecting portions respectively formed to extend from lower ends of the vertical edge portions and correspondingly coupled to the first connecting portions.

According to another aspect, the first connecting portions and the second connecting portions may be mutually coupled by coupling members, and the coupling members may include buttons, Velcro tapes, snap buttons, or hooks.

According to another aspect, the first connecting portions and the second connecting portions may be respectively formed at portions where the vertical edge portions meet the horizontal edge portions, and the vertical edge portions may form curved shapes bulging outwardly from the body portion. Accordingly, when the first connecting portions and the second connecting portions are coupled, each portion of upper and lower ends of the body portion is folded, upper and lower ends of the vertical edge portions are folded inwardly toward the body portion at a predetermined angle, and the first connecting portions and the second connecting portions are disposed inwardly spaced apart from the vertical edge portions by a predetermined distance. Accordingly, when the cover is coupled to the cushion, the cover wraps around the four corners of the cushion, enabling secure coupling and preventing lateral separation of the pillow from the cover.

According to another aspect, elastic bands may be inserted into at least one of the vertical edge portions and the horizontal edge portions.

According to another aspect, strings configured by connecting elastic bands and cords may be inserted into at least one of the vertical edge portions and the horizontal edge portions, wherein the string may include a cord at a middle portion thereof, and elastic bands are respectively connected to both ends of the cord.

According to another aspect, a strap with length-adjustable buckles having loop holes may be incorporated into at least one of the vertical edge portions, the horizontal edge portions, the first connecting portions, and the second connecting portions, and at least one of the vertical edge portions, the horizontal edge portions, the first connecting portions, and the second connecting portions is provided with insertion holes formed by cutting, through which the buckles are inserted and withdrawn.

According to another aspect, the connecting portions may include a strap extending from one of both ends of the vertical edge portions, the first buckle provided on the strap, and the second buckle coupled to a loop portion sewn at the other end of the vertical edge portions and connected with the strap, wherein the first buckle and the second buckle are formed to have a pair of loop holes on both sides of bodies thereof, thereby allowing adjustment of a length of the strap.

According to another aspect, the coupling members may include one or more hook holes formed along a longitudinal direction of the first connecting portions at predetermined intervals, and a hook provided on the second connecting portions configured to engage with the hook holes.

According to another aspect, the second connecting portions may include a hook pocket formed at a position spaced apart from the hook by a predetermined distance on a surface on which the hook is exposed, wherein, when an end portion of the second connecting portions is folded so that the hook is retained within the hook pocket, the hook is prevented from being exposed.

According to another aspect, the first connecting portions and the second connecting portions may be composed of cords capable of being mutually tied in form of a knot, and the coupling members comprise cord length adjusters configured to allow adjustment of lengths of the cords.

According to another aspect, the cover for cushion may further include a cushion position indicator formed on an inner side of the body portion to indicate a position where a cushion is to be placed.

Effect of the Invention

According to a cover for cushion of the present invention, the cover can be easily coupled to and separated from a cushion. Particularly, when coupled by connecting portions and coupling members, the cover firmly wraps around the four corners of the cushion, thereby preventing unintended separation of the cushion from the cover.

According to the cover for cushion of the present invention, the cover can be hygienically used by being easily replaced and frequently washed. Particularly, during washing, damage to other laundry items caused by hooks is prevented.

In addition, according to the cover for cushion of the present invention, the cover can be adjusted in size to fit a cushion without deforming the shape of the cushion.

BEST EMBODIMENT OF THE INVENTION

Figure 1:
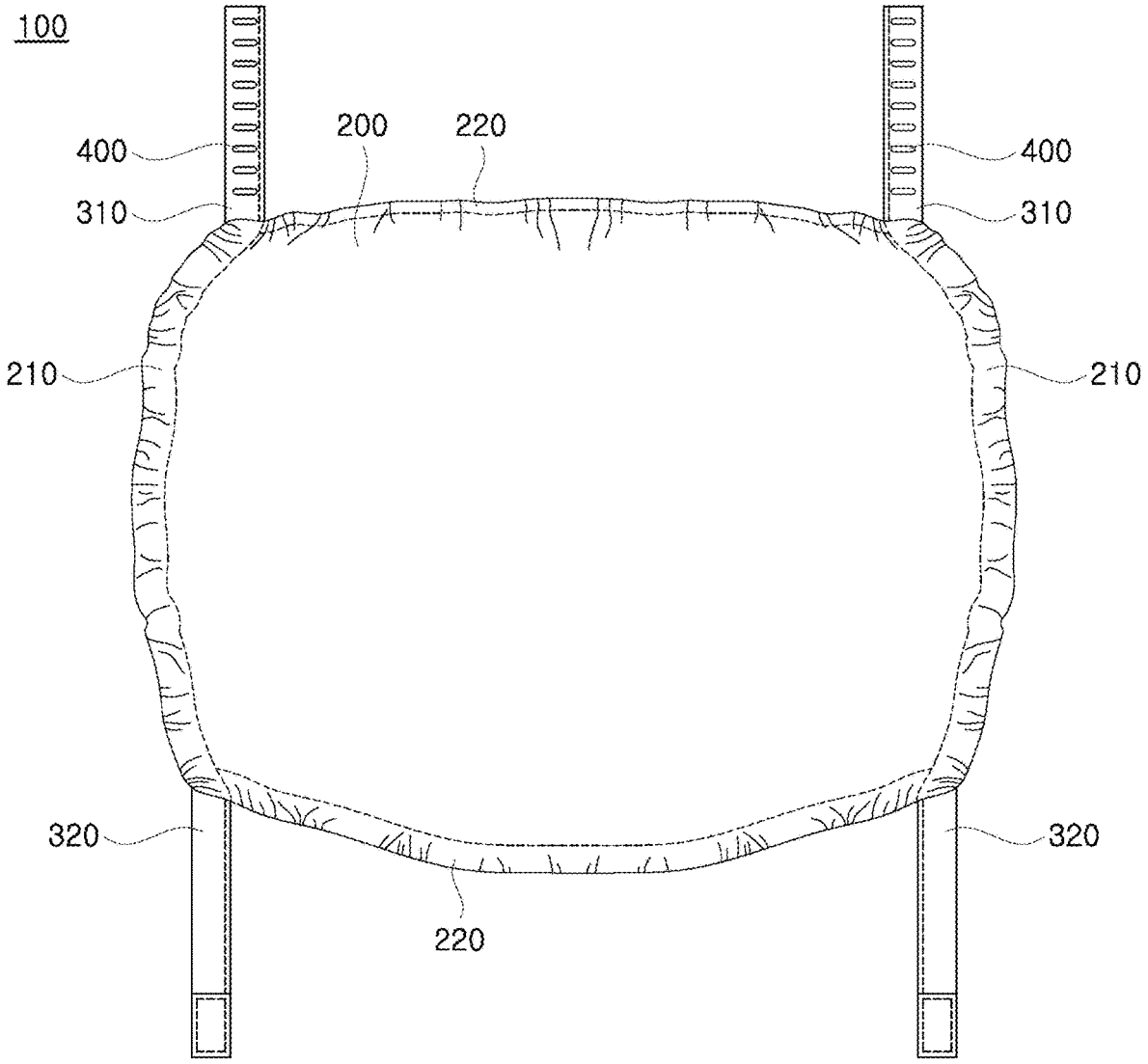
FIGS. 1 to 3 are photographs illustrating a cover for cushion according to a first embodiment of the present invention.

Hereinafter, embodiments of the present disclosure will be described in detail with reference to the accompanying drawings. However, the embodiments described below are intended only to describe the disclosure in detail so that those having ordinary skill in the art to which the disclosure pertains can easily practice the invention, and are not intended to limit the scope of the disclosure. Throughout the description of various embodiments of the present disclosure, the same reference numerals are used to refer to components having the same technical features.

The term 'cushion' as used in the present specification may be applied to all articles having a cushioning function, including pillows, seat cushions, backrests, etc., and is applicable to articles for pets as well as humans. However, for convenience, the present specification describes a pillow as one example of a cushion.

Figure 2:
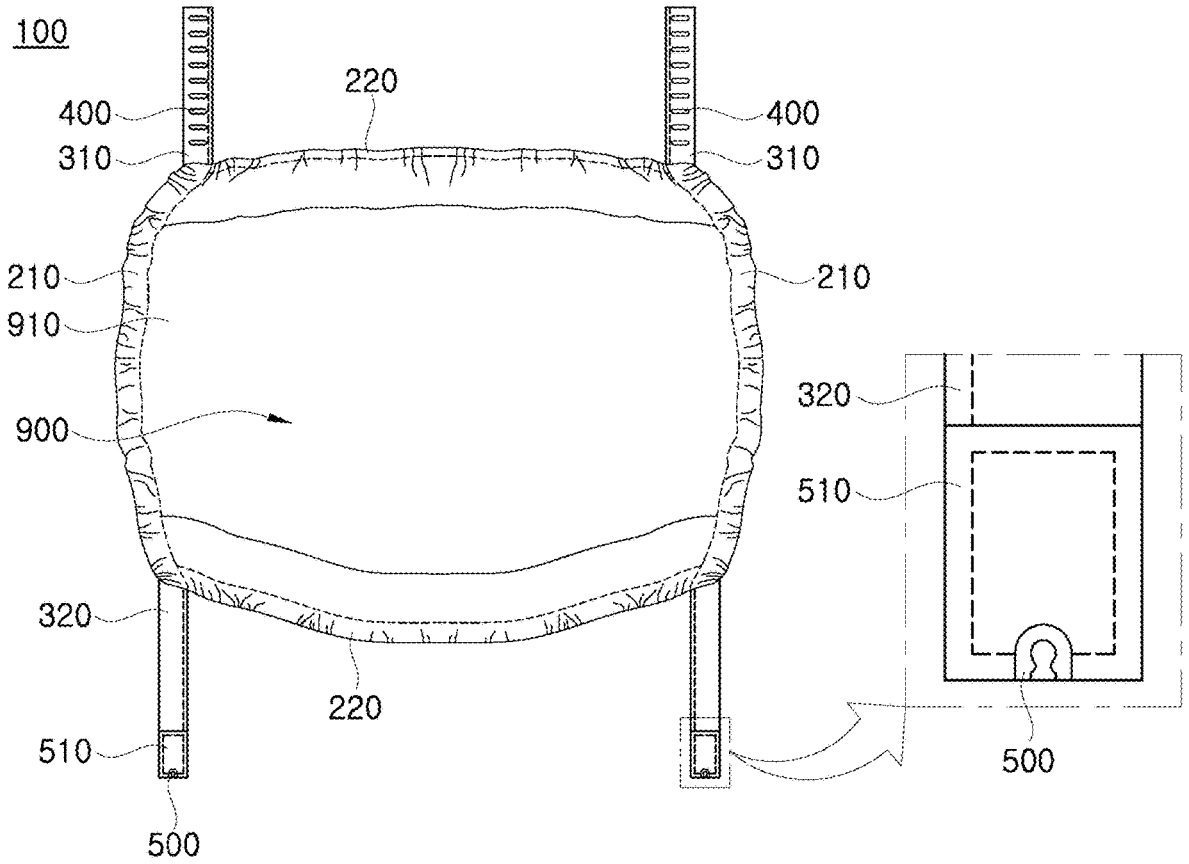
Figure 3:
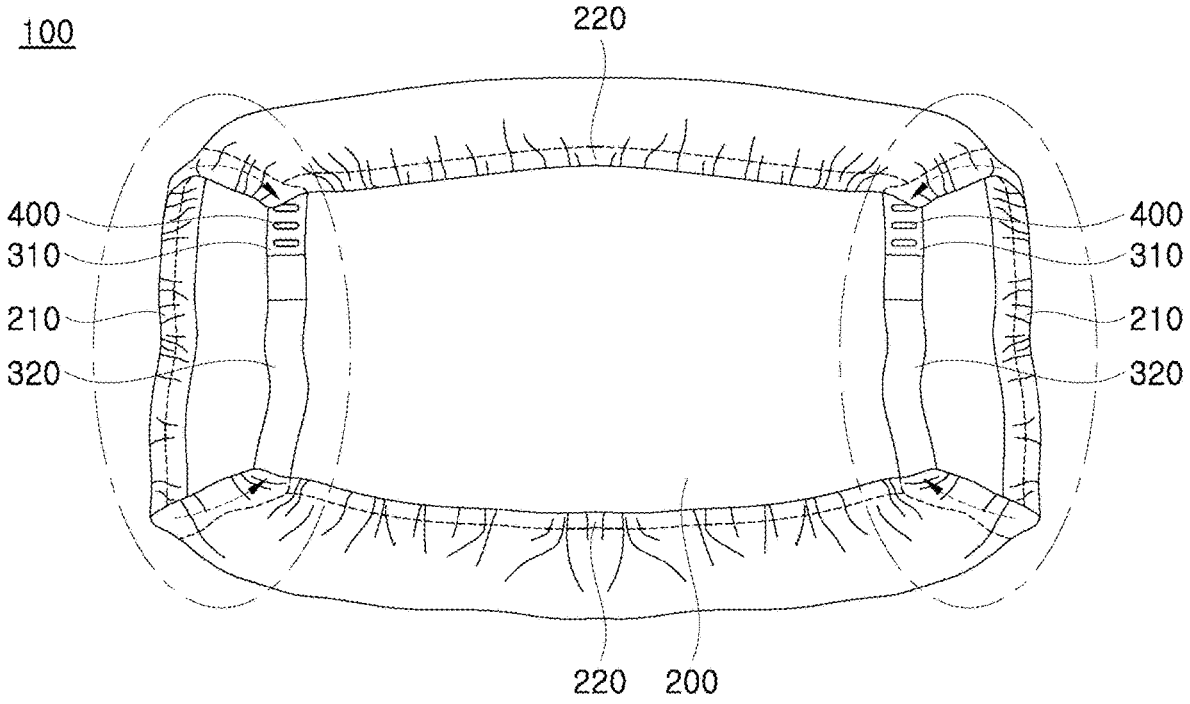
Figure 4:
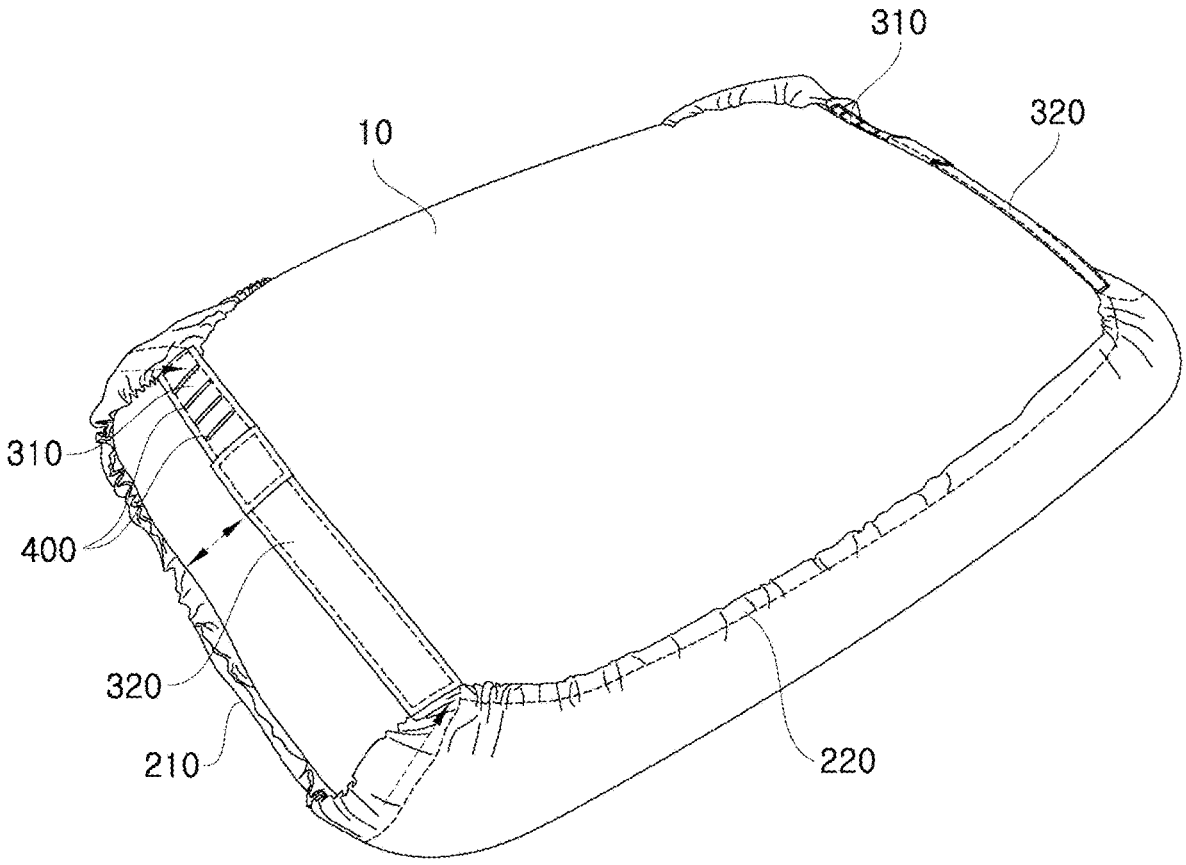
FIG. 4 is a view showing the cover for cushion according to a first embodiment of the present invention in a state of use.

With reference to FIGS. 1 to 3, a cover for cushion according to a first embodiment of the present invention will be described. FIG. 1 is a photograph showing the outer side of the cover for cushion according to the first embodiment, FIG. 2 is a photograph showing the inner side of the cover for cushion according to the first embodiment, FIG. 3 is a photograph showing a state in which first connecting portions and second connecting portions according to the first embodiment are coupled to each other, and FIG. 4 is a photograph showing a cushion coupled to the cover for cushion according to the first embodiment.

A cover for cushion 100 according to the first embodiment may be formed of fabric materials commonly used for bedding, such as cotton, rayon, linen, modal, Tencel, nylon, polyester, and the like, and covers one surface of a cushion, for example, a pillow 10, thereby preventing contamination.

The cover for cushion 100 according to the first embodiment, as illustrated in FIGS. 1 to 3, includes a body portion 200 having a predetermined area for accommodating the pillow 10, a pair of vertical edge portions 210 formed along left and right edges of the body portion 200, respectively, and a pair of horizontal edge portions 220 formed along upper and lower edges of the body portion 200, respectively.

The body portion 200 may be formed by overlaying one or two layers of fabric. The horizontal edge portions 220 may be formed by folding and sewing upper and lower edges of the body portion 200 inward, respectively. In addition, the vertical edge portions 210 may be formed by folding and sewing left and right edges of the body portion 200 inward, respectively.

In addition, when the body portion 200 is formed of two layers of fabric, the upper, lower, left, and right edges of the outer fabric may be folded inward toward the inner fabric and sewn, thereby forming the vertical edge portions 210 and the horizontal edge portions 220.

A pair of first connecting portions 310 are respectively formed to extend from the upper ends of the vertical edge portions 210, and a pair of second connecting portions 320 are respectively formed to extend from the lower ends of the vertical edge portions 210. For example, the first connecting portions 310 may be attached by sewing to the upper ends of the vertical edge portions 210, and the second connecting portions 320 may be attached by sewing to the lower ends of the vertical edge portions 210.

The first connecting portions 310 and the second connecting portions 320 are mutually coupled so as to surround the exterior of the pillow 10 placed on the body portion 200, as illustrated in FIG. 3.

At this time, elastic bands (not shown) may be inserted into the vertical edge portions 210, allowing the width and length of the body portion 200 to be freely adjusted according to the size of the pillow 10. In addition, elastic bands may also be inserted into the horizontal edge portions 220. When elastic bands are inserted into the horizontal edge portions 220 or the vertical edge portions 210, the fabric at the corners of the cover for cushion 100 closely adheres to the pillow 10 without sagging, thereby providing an advantage of preventing the cover for cushion 100 from easily slipping off the pillow 10 during use or movement.

When necessary, the elastic bands may be inserted into only one of the vertical edge portions 210 and the horizontal edge portions 220. Alternatively, the elastic bands may be inserted only into partial sections (e.g., central portions) of the overall length of the vertical edge portions 210 and the horizontal edge portions 220.

In addition, strings (not shown) formed by connecting elastic bands and cords may be inserted into the vertical edge portions 210, and strings formed by connecting elastic bands and cords may also be inserted into the horizontal edge portions 220. When necessary, the strings formed by connecting elastic bands and cords may be inserted into only one of the vertical edge portions 210 and the horizontal edge portions 220.

In one example, the string may include a cord at a middle portion thereof, with elastic bands of predetermined lengths respectively connected to both ends of the cord. In another example, the string may include an elastic band at a middle portion thereof, with cords of predetermined lengths respectively connected to both ends of the elastic band.

In this case, the cord may be made of a non-elastic material. When a string including a cord connected to an elastic band is inserted, fewer wrinkles occur on the vertical and horizontal edge portions 210 and 220 of the cover for cushion 100 compared to cases in which only elastic bands are inserted, thereby achieving an improved, smooth appearance.

In addition, coupling of the first connecting portions 310 and the second connecting portions 320 may be accomplished by coupling members. That is, a first coupling member is provided on the first connecting portions 310, and a second coupling member configured to correspondingly engage with the first coupling member is provided on the second connecting portions 320, whereby the first connecting portions 310 and the second connecting portions 320 are coupled by engagement between the first coupling member and the second coupling member.

In the drawings, as the first coupling members, at least one or more hook holes 400 are formed along the longitudinal direction of the first connecting portions 310 at predetermined intervals. As the second coupling member, a hook 500 is provided at the ends of the second connecting portions 320. In this configuration, a user may freely adjust the connecting length between the first connecting portions 310 and the second connecting portions 320 according to the size of the pillow 10 by selectively inserting and coupling the hook 500 of the second connecting portions 320 into any one of the plurality of hook holes 400 provided in the first connecting portions 310.

In addition, it is possible to tie and fasten the first connecting portions 310 and the second connecting portions 320 formed of fabric, cords, or elastic bands in a knot, without using separate coupling members. Alternatively, it is also possible to couple the first connecting portions 310 and the second connecting portions 320 formed of fabric, cords, or elastic bands by using a cord length adjuster 810 (see FIG. 9) as a coupling member and adjust the connecting length therebetween.

In addition, referring to FIG. 2, a hook pocket 510 capable of accommodating the hook 500 may be formed on one side of an end portion of the second connecting portions 320. The hook pocket 510 is provided to prevent damage to other laundry items due to friction between the hook 500 and the laundry items during washing, and is formed at a position spaced apart from the hook 500 by a predetermined distance on a surface where the hook 500 is exposed. The user may fold the end portion of the second connecting portions 320 inward, causing the hook 500 to be inserted into and retained within the hook pocket 510, thereby preventing the hook 500 from being externally exposed. Accordingly, during washing, it is possible to prevent laundry items from catching on the hook 500, thereby avoiding tearing or damage. The hook pocket 510 may be formed integrally with the second connecting portions 320 or, alternatively, as illustrated in the drawings, the hook pocket 510 may be formed by sewing an additional piece of fabric onto the second connecting portions 320. In this case, an unsewn portion formed centrally at the upper side of the hook pocket 510 serves as an entrance through which the hook 500 is inserted.

The lengths of the first connecting portions 310 and the second connecting portions 320 may be appropriately selected as needed. For example, the first connecting portions 310 and the second connecting portions 320 may be formed to have equal lengths, or the length of the first connecting portions 310 may be longer or shorter than that of the second connecting portions 320.

In addition, although the embodiment shown in the drawings illustrates an example where no elastic band is inserted into the first connecting portions 310 and the second connecting portions 320, this is merely one embodiment of the present invention. When necessary, elastic bands may be inserted into the first connecting portions 310 and the second connecting portions 320 to freely adjust the lengths thereof according to the size of the pillow 10. In this case, the elastic bands may be inserted into both the first connecting portions 310 and the second connecting portions 320, or alternatively, an elastic band may be inserted into only one of either the first connecting portions 310 or the second connecting portions 320.

In addition, besides the aforementioned hook holes 400 and hook 500, it is obvious that, when necessary, the coupling member may be implemented in various mutually engageable types, such as buttonholes and buttons, male and female Velcro tapes, or male and female snap buttons.

In addition, the first connecting portions 310 and the second connecting portions 320 may be formed respectively at portions where the vertical edge portions 210 meet the horizontal edge portions 220. Further, the vertical edge portions 210 may form a curved shape protruding outwardly from the body portion 200 (see FIG. 2). Accordingly, when the first connecting portions 310 and the second connecting portions 320 are coupled, respective portions of the upper and lower ends of the body portion 200 are folded, and the upper and lower ends of the vertical edge portions 210 are folded inwardly toward the body portion 200 at a predetermined angle (refer to arrows in FIG. 3). Moreover, the first connecting portions 310 and the second connecting portions 320 are spaced apart inwardly by a predetermined distance from the vertical edge portions 210 (see FIG. 3).

Thus, after placing the pillow inside the body portion 200, that is, inwardly of the vertical edge portions 210 and the horizontal edge portions 220, when the first connecting portions 310 and the second connecting portions 320 are coupled, the first connecting portions 310 and the second connecting portions 320 securely surround and fix the pillow at positions spaced inwardly from both ends of the pillow, as shown in FIG. 4. In addition, the folded upper and lower portions of the body portion 200, along with the inclined folded portions of the vertical edge portions 210, enclose the four corners of the pillow. Therefore, the pillow is firmly coupled, effectively preventing the pillow from laterally slipping out of the cover 100. That is, the shape of the vertical edge portions 210 and the positions at which the first connecting portions 310 and the second connecting portions 320 are formed, alone, achieve the effect of preventing lateral displacement of the pillow.

In addition, a cushion position indicator 900 may be formed on the inner side of the body portion 200. The cushion position indicator 900 serves to indicate to a user the position where the cushion is to be placed on the inner surface of the cover for cushion 100 when coupling the cover for cushion 100 to the cushion. For example, by positioning the pillow 10 according to the cushion position indicator 900, the cover for cushion 100 may be accurately fitted onto the pillow 10 without vertical misalignment at once. As an example, as shown in FIG. 2, the cushion position indicator 900, indicating a distinguished area for placing the pillow 10, may be formed by coupling a fabric piece having a predetermined area (hereinafter, cushion position indicator fabric 910) to the inner side of the body portion 200. In this case, when the cushion position indicator 900 is formed using a cushion position indicator fabric 910 having a different color from that of the body portion 200, it provides the advantage of enhanced visibility, thus facilitating ease of use.

Here, when the cushion position indicator fabric 910, having a predetermined area, is sewn onto the inner side of the single-layered body portion 200, the sewing lines may become exposed on the outer surface of the body portion 200, negatively affecting the aesthetics. To prevent this, as shown in FIG. 2, the upper and lower edges of the body portion 200 are folded inward, after which the folded upper and lower edges of the body portion 200 are sewn together with the upper and lower edges of the cushion position indicator fabric 910. Subsequently, the left and right edges of the body portion 200 are folded inward, and the folded left and right edges of the body portion 200 are sewn together with the left and right edges of the cushion position indicator fabric 910, thereby forming the horizontal edge portions 220 and the vertical edge portions 210, respectively. In this configuration, the cushion position indicator fabric 910 defines a visually distinguishable cushion position indicator 900 on the inner side of the body portion 200. As previously described, selecting the cushion position indicator fabric 910 in a different color from that of the body portion 200 enhances visibility.

Figure 5:
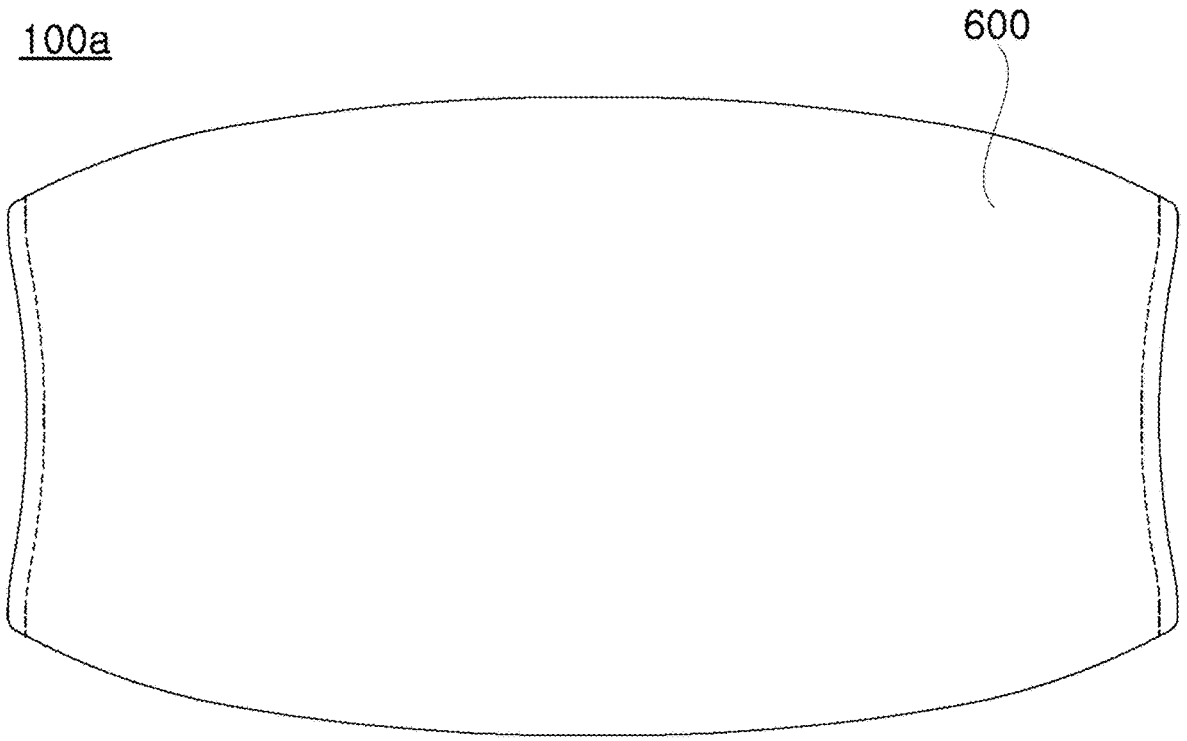
FIGS. 5 and 6 are photographs illustrating a cover for cushion according to a second embodiment of the present invention.
Figure 6:
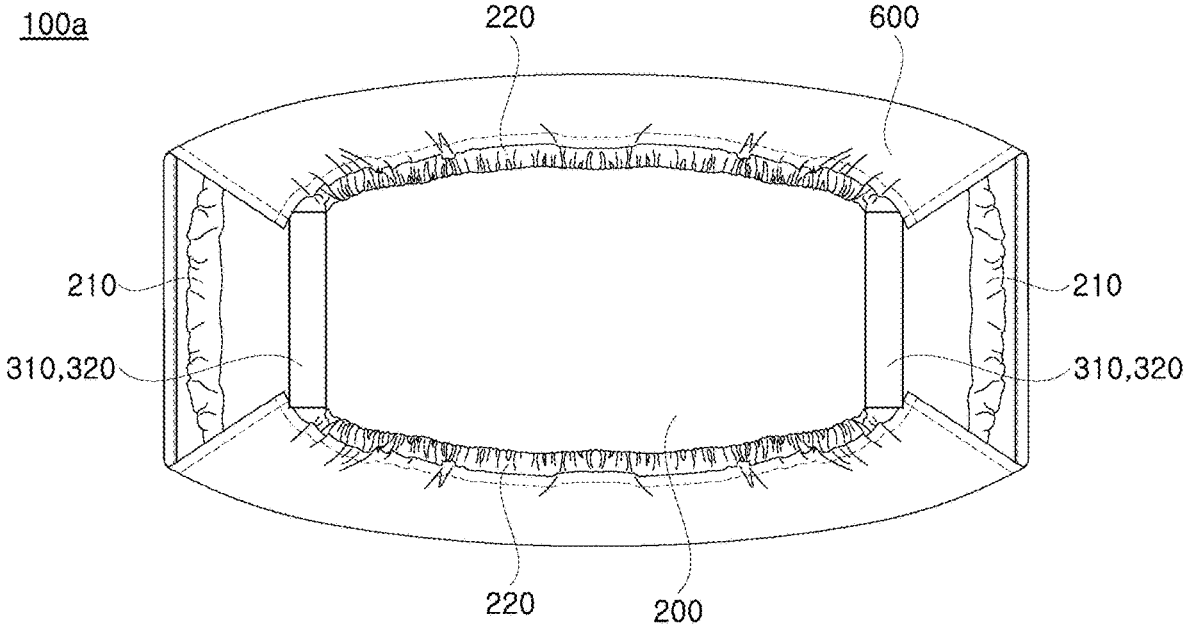

With reference to FIGS. 5 and 6, a cover for cushion according to a second embodiment of the present invention will be described. FIG. 5 is a photograph illustrating the outer side of a cover for cushion according to the second embodiment, and FIG. 6 is a photograph illustrating the inner side of the cover for cushion according to the second embodiment. A cover for cushion 100*a* according to the second embodiment is generally similar in configuration to the cover for cushion 100 according to the first embodiment described above, in that the cover for cushion 100*a* includes the body portion 200, the vertical edge portions 210, the horizontal edge portions 220, the first connecting portions 310, and the second connecting portions 320. However, the cover for cushion 100*a* according to the second embodiment differs in that the cover for cushion 100*a* further includes a cover 600 configured to overlay the outer side of the body portion 200. Differences relative to the first embodiment will be described in further detail below.

In the cover for cushion 100*a* according to the second embodiment, the cover 600 is coupled to the outer side of the body portion 200. The cover 600 is formed from a fabric having a length greater than the length (horizontal direction) of the body portion 200, so as to overlay the outer side of the body portion 200. For example, opposite ends of the cover 600 in the width direction (vertical direction) may be sewn to the horizontal edge portions 220 of the body portion 200. Although the drawings illustrate an example where the width of the cover 600 is shorter than that of the body portion 200, this is merely illustrative, and the width of the cover 600 may be the same as or greater than that of the body portion 200.

In addition, in the cover for cushion 100*a* according to the second embodiment, the body portion 200 is concealed by the cover 600. Thus, when the pillow 10 is inserted, even when the four corners of the body portion 200 become rounded due to elastic deformation of elastic bands inserted into the vertical edge portions 210 and/or the horizontal edge portions 220, these deformed corners are hidden by the cover 600, thereby enhancing the overall aesthetic appearance.

In addition, although FIG. 6 illustrates an example in which the first connecting portions 310 and the second connecting portions 320 are coupled together by Velcro tapes, this is merely illustrative, and various other mutually engageable types, such as hook holes and hooks, buttonholes and buttons, or male and female snap buttons, may also be applied as coupling members.

Figure 7:
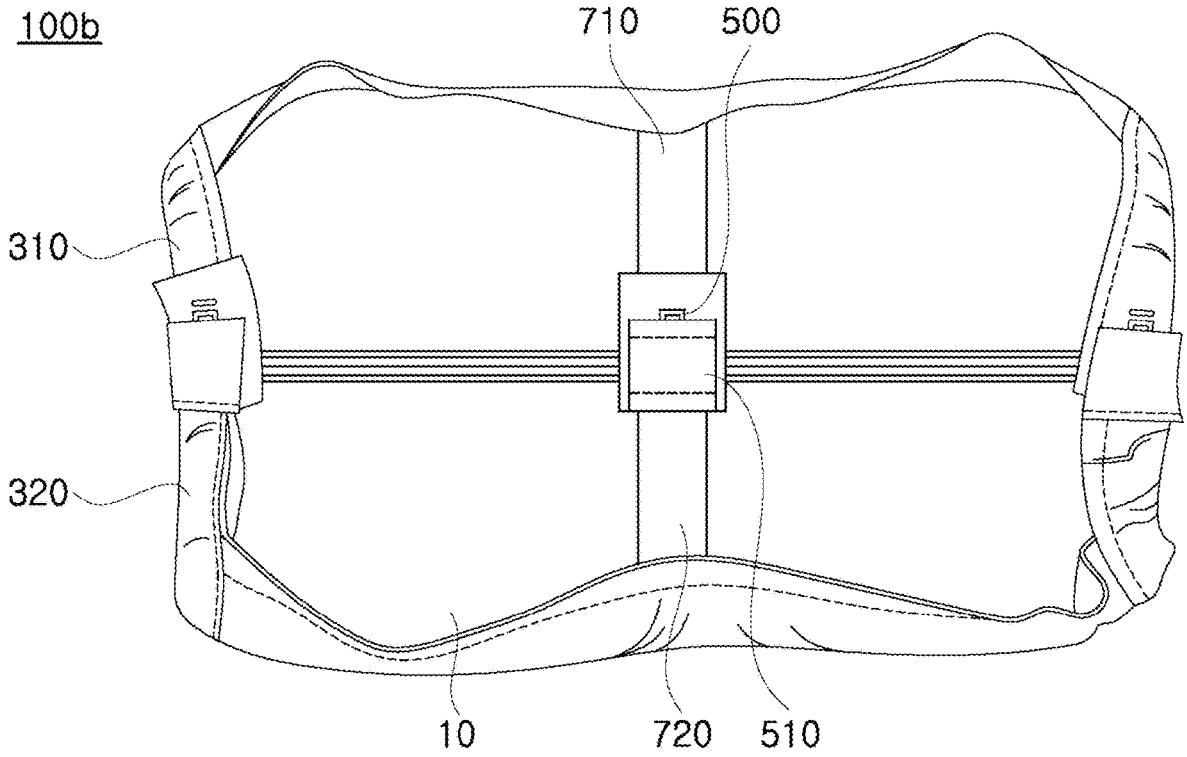
FIGS. 7 and 8 are photographs illustrating a cover for cushion according to a third embodiment of the present invention.
Figure 8:
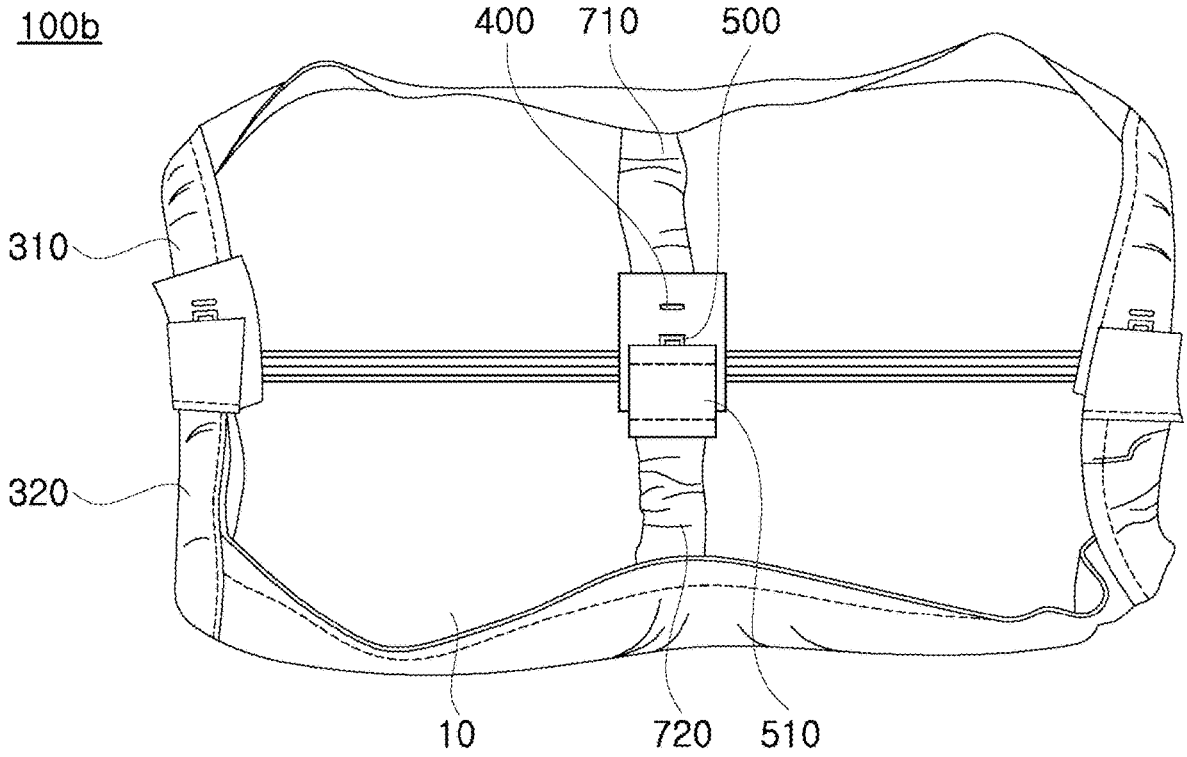

With reference to FIGS. 7 and 8, a cover for cushion according to a third embodiment of the present invention will be described. FIGS. 7 and 8 are photographs illustrating the inner side of the cover for cushion according to the third embodiment. A cover for cushion 100*b* according to the third embodiment is generally similar in configuration to the cover for cushion 100 according to the first embodiment, in that the cover for cushion 100*b* includes the body portion 200, the vertical edge portions 210, the horizontal edge portions 220, the first connecting portions 310, and the second connecting portions 320. However, the cover for cushion 100*b* according to the third embodiment differs from the cover for cushion 100 of the first embodiment in that the cover for cushion 100*b* further includes a first auxiliary connecting portion 710 and a second auxiliary connecting portion 720, which respectively connect the middle parts of the upper and lower edges of the body portion 200. Differences relative to the first embodiment will be described in detail below.

In the cover for cushion 100*b* according to the third embodiment, the first auxiliary connecting portion 710 having a predetermined width and length is formed extending from the middle part of the upper edge of the body portion 200, and the second auxiliary connecting portion 720 having a predetermined width and length is formed extending from the middle part of the lower edge of the body portion 200. Here, the first auxiliary connecting portion 710 and the second auxiliary connecting portion 720 function together with the first and second connecting portions 310, 320 to secure the cover for cushion 100*b* to the pillow 10. Similar to the aforementioned first and second connecting portions 310 and 320, the first and second auxiliary connecting portions 710 and 720 may be coupled to each other by being tied together, or alternatively, the first and second auxiliary connecting portions 710 and 720 may be coupled through the previously described coupling members.

For reference, the drawings illustrate an example in which the hook holes 400 serving as a first coupling member are formed on the first auxiliary connecting portion 710, and the hook 500 serving as a second coupling member is provided on the second auxiliary connecting portion 720. In addition, separate fabric pieces having the hook holes 400 formed therein are additionally sewn onto the first connecting portions 310 and the first auxiliary connecting portion 710, and separate fabric pieces provided with the hook 500 are additionally sewn onto the second connecting portions 320 and the second auxiliary connecting portion 720. Here, it is apparent that the hook pocket 510 may also be formed on the second connecting portions 320 and the second auxiliary connecting portion 720. Moreover, this configuration where separate fabric pieces provided with the hook holes 400 and the hook 500 respectively are sewn onto the first and second connecting portions 310 and 320 may also be applied to the previously described embodiments.

In addition, FIG. 7 illustrates an example in which no elastic bands are inserted into the first auxiliary connecting portion 710 and the second auxiliary connecting portion 720, whereas FIG. 8 illustrates an example in which elastic bands are respectively inserted into the first auxiliary connecting portion 710 and the second auxiliary connecting portion 720. When necessary, an elastic band may be inserted into only one of either the first auxiliary connecting portion 710 or the second auxiliary connecting portion 720.

In addition, an elastic band may be inserted into at least one of the first connecting portions 310 and the second connecting portions 320. Further, an elastic band may be inserted into at least one of the vertical edge portions 210, and similarly, an elastic band may also be inserted into at least one of the horizontal edge portions 220.

Figure 9:
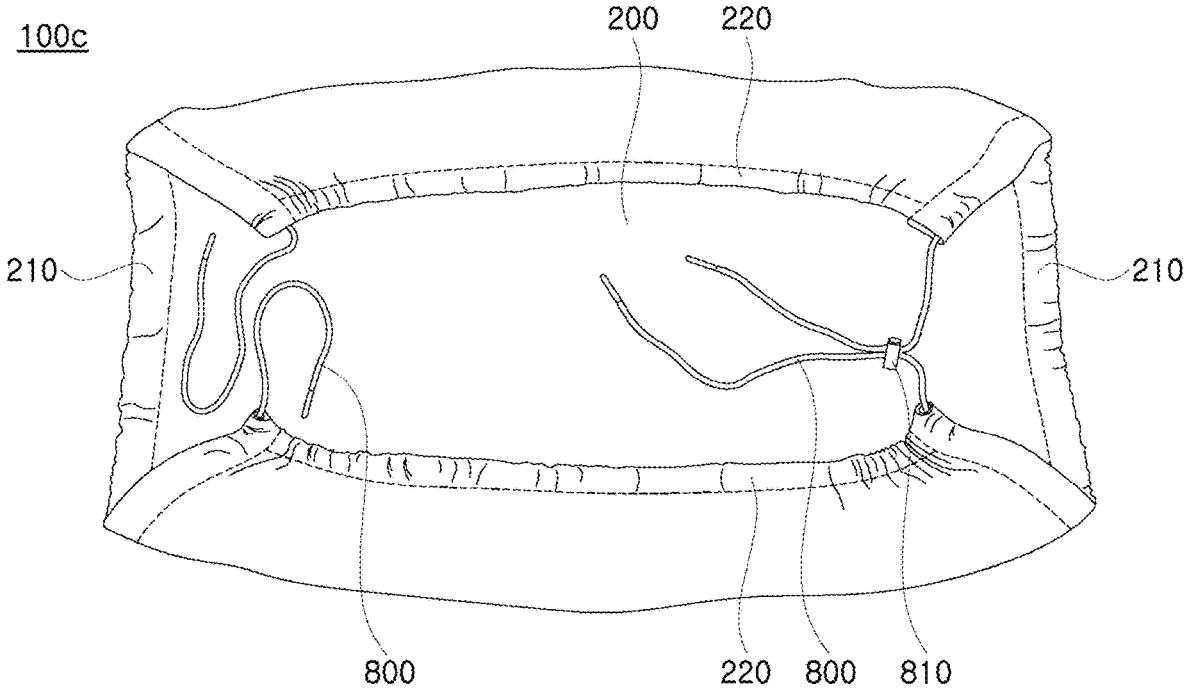
FIGS. 9 and 10 are photographs illustrating a cover for cushion according to a fourth embodiment of the present invention.
Figure 10:
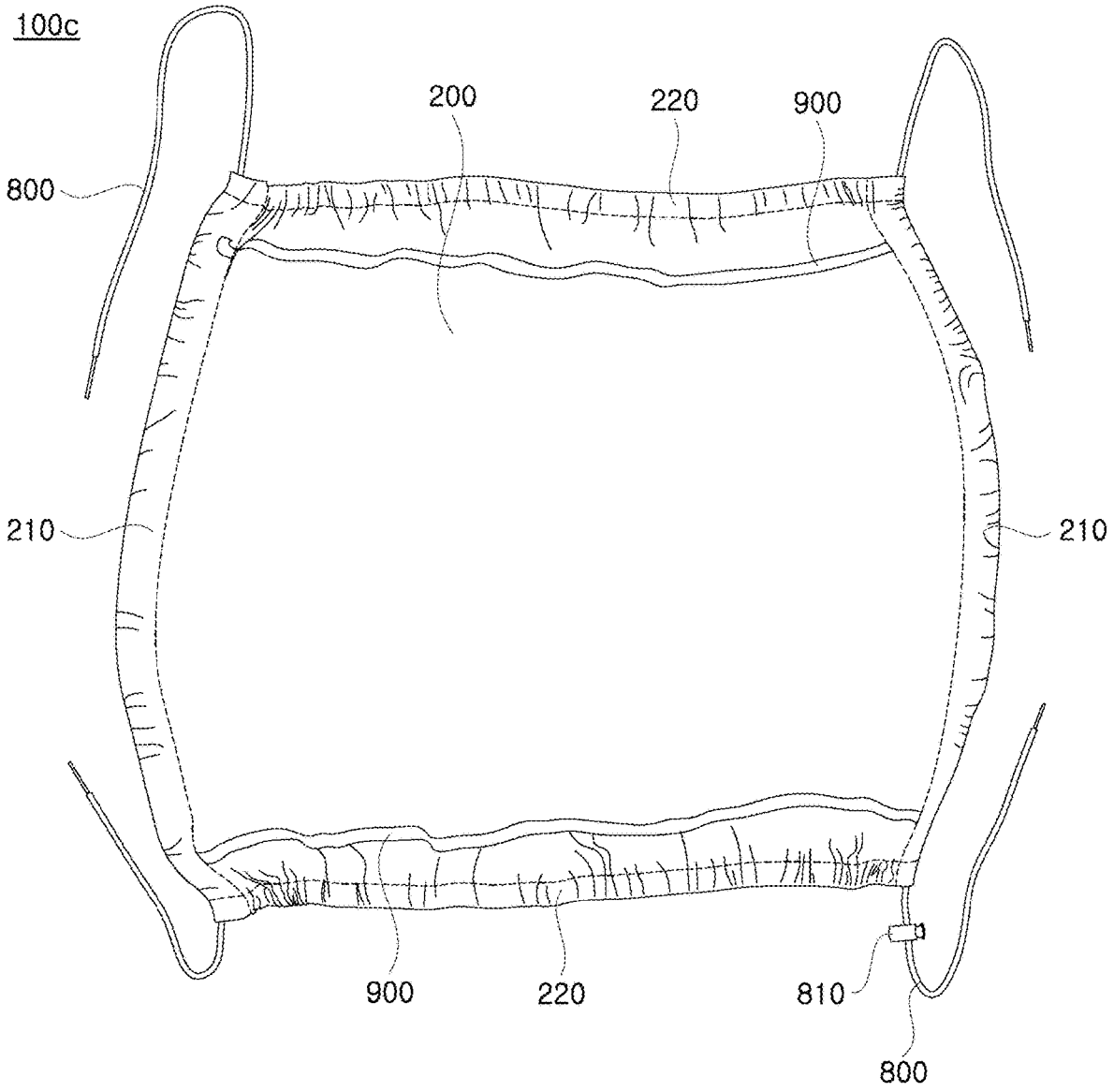

With reference to FIGS. 9 and 10, a cover for cushion according to a fourth embodiment of the present invention will be described. FIG. 9 is a photograph illustrating the inner side of a cover for cushion according to the fourth embodiment, and FIG. 10 is a photograph illustrating the cover for cushion of FIG. 9 in an unfolded state. A cover for cushion 100*c* according to the fourth embodiment is generally similar in configuration to the cover for cushion 100 of the first embodiment described above, in that the cover for cushion 100*c* includes the body portion 200, the vertical edge portions 210, the horizontal edge portions 220, the first connecting portions 310, and the second connecting portions 320. However, the cover for cushion 100*c* of the fourth embodiment differs from the cover for cushion 100 of the first embodiment in that the cover for cushion 100*c* utilizes strings 800 inserted into the vertical edge portions 210, without separate connecting portions, to attach the cover for cushion 100 to the pillow 10. Differences relative to the first embodiment will be described below.

The cover for cushion 100*c* according to the fourth embodiment differs from the cover for cushion 100 of the first embodiment in that the first and second connecting portions 310 and 320 for mounting the cover for cushion 100*c* onto the pillow 10 are not formed. Instead, the strings 800 are inserted into the vertical edge portions 210, and the cover for cushion 100*c* is mounted onto the pillow 10 by tying both ends of the strings 800 exposed outward from the vertical edge portions 210. In this case, the strings 800 may be tied in the form of a knot by the user. When necessary, a conventional cord length adjuster 810 may be provided at one side of the strings 800, allowing the length of the strings 800 to be adjusted according to the size of the pillow 10.

In addition, as illustrated in FIG. 10, the cushion position indicator 900 is formed on the inner side of the body portion 200. The cushion position indicator 900 indicates the position at which the cushion should be placed on the inner surface of the cover for cushion 100*c* when coupling the cover for cushion 100*c* to the cushion. For example, when the pillow 10 is placed according to the cushion position indicator 900, the pillow 10 may be properly covered by the cover for cushion 100*c* at once without vertical misalignment. In this case, the cushion position indicator 900 may be formed by sewing separate strip-shaped fabrics to the inner side of the body portion 200 at predetermined vertical intervals according to the size of the pillow 10.

In another example, the cushion position indicator 900 may be formed by printed lines or stitch lines on the inner side of the body portion 200. In yet another example, the cushion position indicator 900 may be formed by sewing and attaching an additional piece of fabric having a predetermined area onto the inner side of the body portion 200, thereby distinguishing the position for placing the pillow 10. In this case, the cushion position indicator 900 may, for example, be formed of a fabric piece having a different color from that of the body portion 200. Alternatively, the cushion position indicator 900 may also be formed by sewing and attaching a different type of fabric (e.g., thinner fabric, thicker fabric, stiffer fabric, waterproof fabric, silicone-coated fabric, etc.) onto a predetermined area of the body portion 200.

Figure 11:
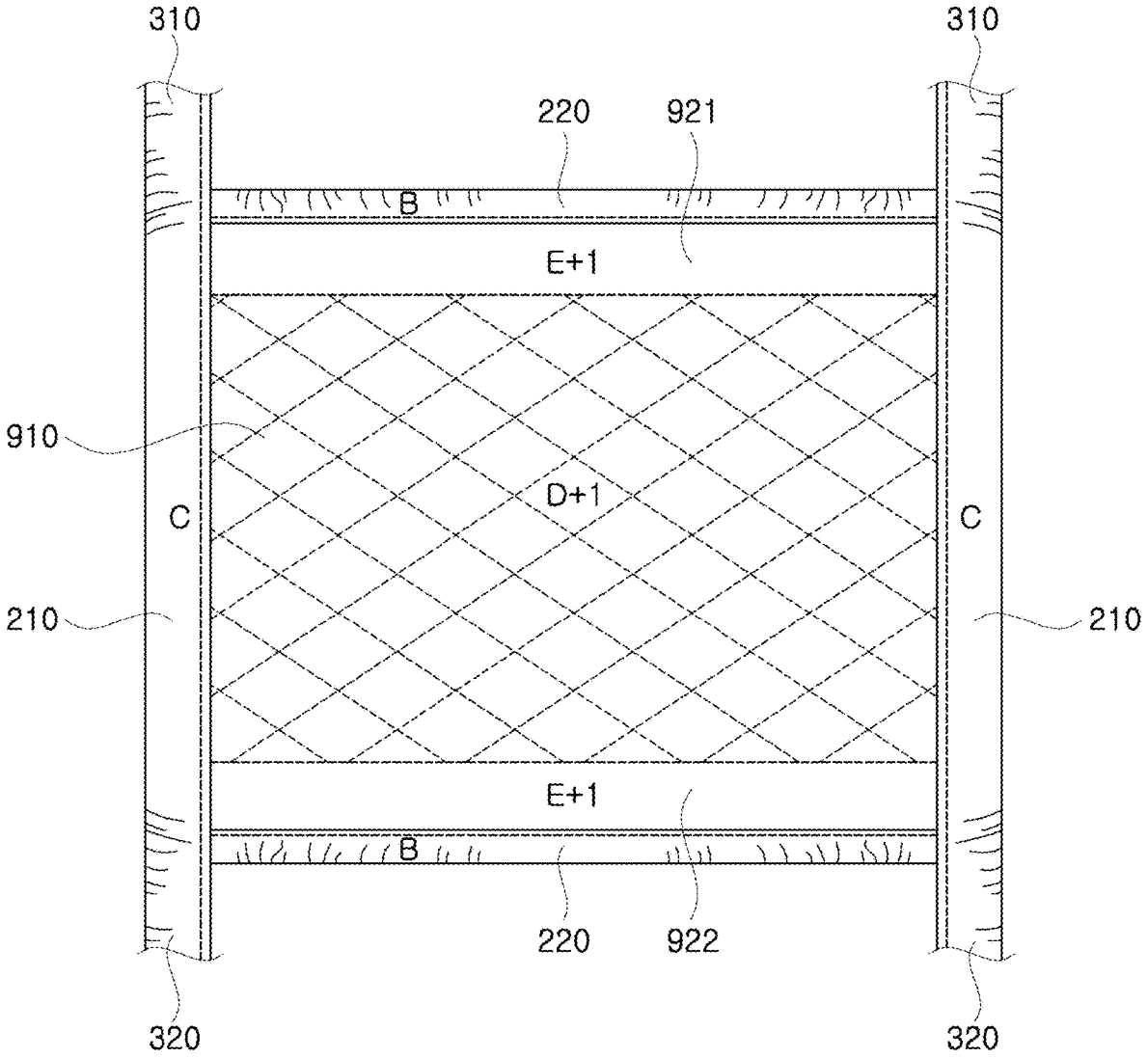
FIGS. 11 and 12 are photographs illustrating an example in which a cushion position indicator is formed on the inner side of the cover.
Figure 12:
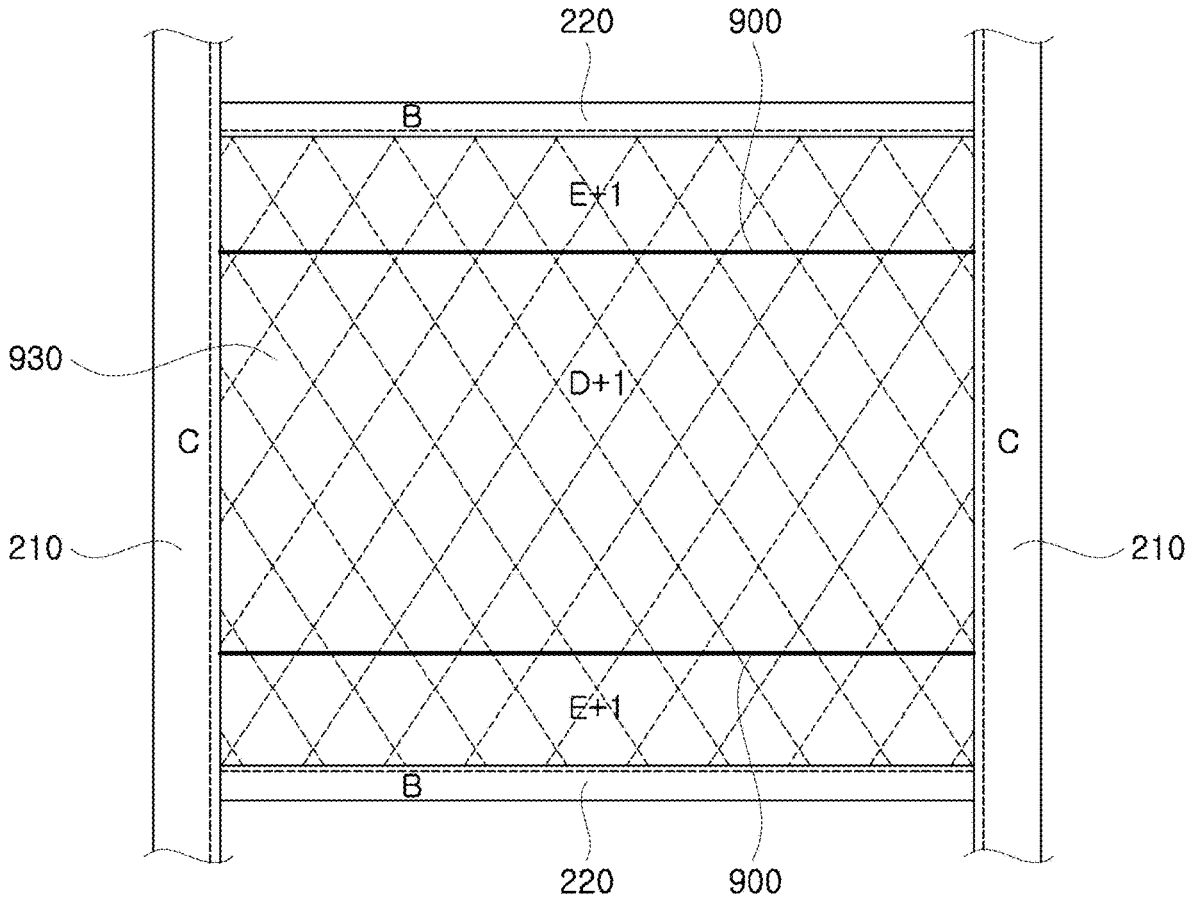

FIGS. 11 and 12 are photographs illustrating an example of forming the cushion position indicator on the inner side of the cover for cushion, wherein the sewing lines of the cushion position indicator 900 are configured not to be exposed on the outer surface of the cover for cushion. That is, when sewing a cushion position indicator fabric 910 having a predetermined area to the inner side of the body portion 200 formed of a single layer, this configuration improves aesthetic appearance by preventing the sewing lines from being exposed on the outer surface of the body portion 200. For reference, the cushion position indicator 900 described with reference to FIGS. 11 and 12 may also be applied, when necessary, to the first to fourth embodiments.

As illustrated in FIG. 11, a pair of auxiliary fabrics 921 and 922 (portions marked "E+1") may be further coupled between the cushion position indicator fabric 910 and the horizontal edge portions 220. For example, a lower edge of the first auxiliary fabric 921 may be sewn along an upper edge of the cushion position indicator fabric 910, and an upper edge of the first auxiliary fabric 921 may be sewn to the horizontal edge portions 220 (portion marked "B") at the upper side of the body portion 200. In addition, an upper edge of the second auxiliary fabric 922 may be sewn along a lower edge of the cushion position indicator fabric 910, and a lower edge of the second auxiliary fabric 922 may be sewn to the horizontal edge portions 220 at the lower side of the body portion 200. In this case, the left and right edges of the cushion position indicator fabric 910 and the first and second auxiliary fabrics 921 and 922 are sewn to the vertical edge portions 210 (portions marked "C"). Accordingly, the sewing lines at the upper and lower edges of the cushion position indicator fabric 910 are concealed by the body portion 200. As the sewing lines of the cushion position indicator fabric 910 are not exposed on the outer surface of the body portion 200, aesthetic appearance is enhanced, and discomfort due to rough sewing lines contacting the skin may also be prevented.

FIG. 12 illustrates an example in which an additional fabric 930 is attached to the inner side of the body portion 200 by sewing an upper edge of the fabric 930 to the horizontal edge portions 220 (portion marked "B") at the upper side of the body portion 200, and by sewing a lower edge thereof to the horizontal edge portions 220 (portion marked "B") at the lower side of the body portion 200. In this case, the left and right edges of the fabric 930 are sewn to the vertical edge portions 210 (portions marked "C") of the body portion 200. Here, the cushion position indicator 900 may be indicated by printed lines on the attached fabric 930 to distinguish the position for placing the pillow 10 (portion marked "D+1"). In FIG. 12, the portion marked "E+1" corresponds to the regions of the first and second auxiliary fabrics 921 and 922 illustrated in FIG. 11 (portion marked "E+1" in FIG. 11).

In another example, the cushion position indicator 900 may be formed by sewing strip-shaped fabrics onto the attached fabric 930 at predetermined vertical intervals. In yet another example, the cushion position indicator 900 may be formed by sewing stitch lines on the attached fabric 930, or by sewing and attaching an additional piece of fabric (not shown) having a predetermined area onto the attached fabric 930. Here, the additional fabric may have the same or different color or material from the attached fabric 930. In addition, for ease of manufacturing, it is preferable to form the cushion position indicator 900 on the fabric 930 in advance, prior to attaching the fabric 930. However, when necessary, it is also possible to form the cushion position indicator 900 after attaching the fabric 930, as described above.

In addition, the body portion 200, the vertical edge portions 210, the horizontal edge portions 220, the first connecting portions 310, the second connecting portions 320, the first auxiliary connecting portion 710, and the second auxiliary connecting portion 720 of the aforementioned embodiments of the present invention may be formed of the same fabric material or different fabric materials. For example, the body portion 200, which directly contacts the skin when the cover for cushion is mounted on the pillow 10, may be formed of soft 100-thread-count cotton fabric. On the other hand, considering that the vertical edge portions 210 and the horizontal edge portions 220 are located at edges and may easily wear out due to repeated stretching caused by insertion of elastic bands, the vertical edge portions 210 and the horizontal edge portions 220 may be formed of durable cotton fabric. In addition, various fabric materials may be selected for each component depending on the structure and function of the cover for cushions 100 to 100*c*.

Figure 13:
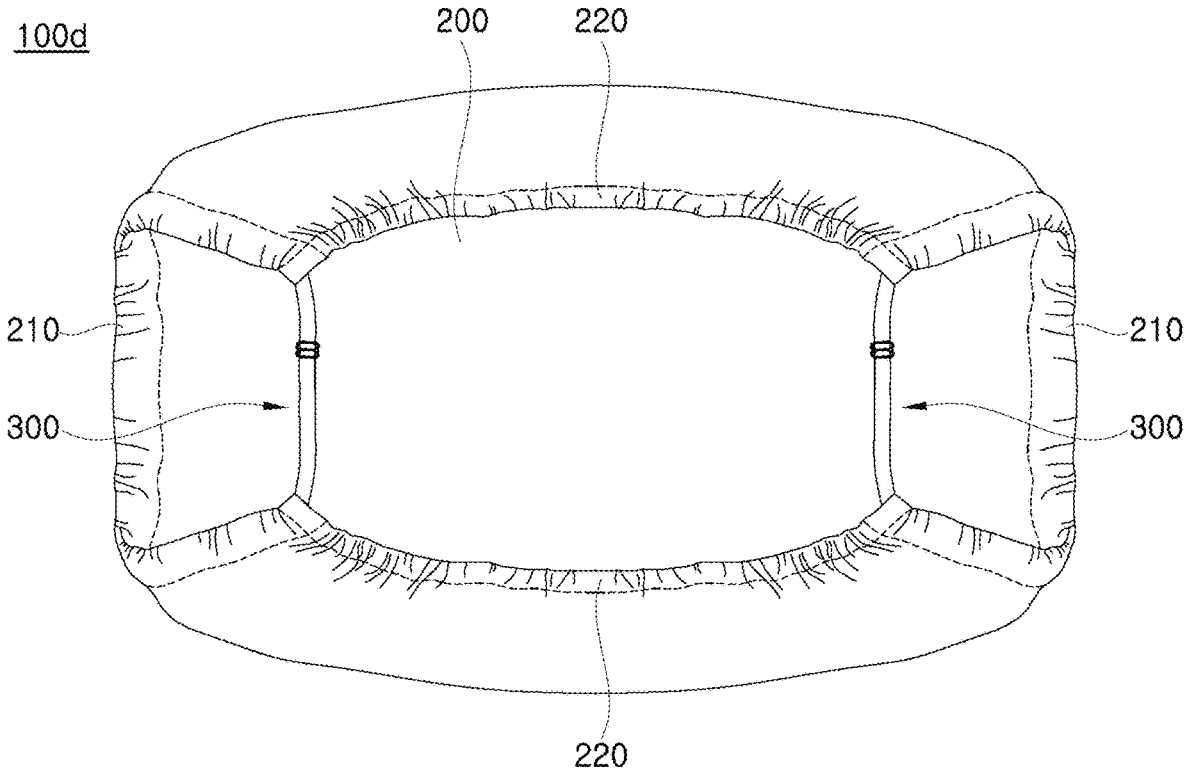
FIGS. 13 and 14 are photographs illustrating a cover for cushion according to a fifth embodiment of the present invention.
Figure 14:
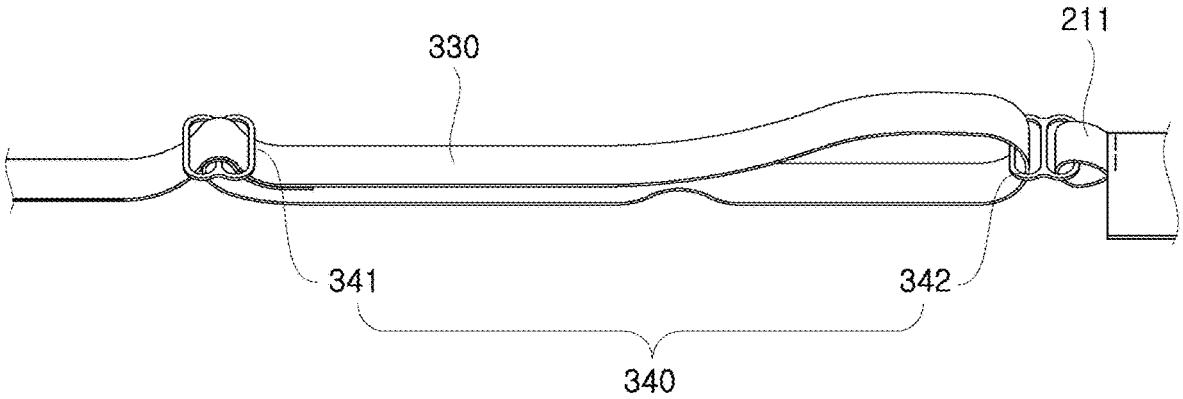

With reference to FIGS. 13 and 14, a cover for cushion according to a fifth embodiment of the present invention will be described. FIG. 13 is a photograph showing an inner side of the cover for cushion according to the fifth embodiment, and FIG. 14 is a photograph illustrating the strap, the first buckle, and the second buckle of the fifth embodiment. A cover for cushion 100*d* according to the fifth embodiment is generally similar to the cover for cushion 100 according to the aforementioned first embodiment in that the cover for cushion 100*d* includes the body portion 200, the vertical edge portions 210, the horizontal edge portions 220, and a pair of connecting portions 300, and in that strings may be inserted into the vertical edge portions 210 and the horizontal edge portions 220. However, the cover for cushion 100*d* according to the fifth embodiment differs from the first embodiment in that the connecting portions 300 include a strap 330 and buckles 340. The differences from the first embodiment will be mainly described below.

In the cover for cushion 100*d* according to the fifth embodiment, the connecting portions 300 are formed to mutually connect both ends of the vertical edge portions 210. Here, the connecting portions 300 include a strap 330 extending from one of the ends of the vertical edge portions 210, a first buckle 341 provided on the strap 330, and a second buckle 342 coupled to the other of the ends of the vertical edge portions 210.

The strap 330 may be formed as a band having a predetermined width and length, composed of fabric or elastic material, with one end of the strap 330 sewn to one of the ends of the vertical edge portions 210. The first buckle 341 is provided on one side along the length of the strap 330. For example, the first buckle 341 may be configured to include a pair of loop holes through which the strap 330 passes on both sides of the body thereof. The second buckle 342 is coupled to the other of the ends of the vertical edge portions 210 and may be configured to have the same shape as the first buckle 341. As illustrated in FIG. 14, a loop portion 211 sewn to the other of the ends of the vertical edge portions 210 is coupled through one loop hole of the second buckle 342, while the other end of the strap 330 passes through the remaining loop hole and connects to the first buckle 341. By using the first buckle 341 and the second buckle 342, the length of the connecting portions 300 may be adjusted by tightening or loosening the strap 330.

In addition, the coupling structure utilizing the strap 330 and the buckles 340 applied to the cover for cushion 100*d* according to the fifth embodiment may be applied to the horizontal edge portions 220 or the vertical edge portions 210, as well as respectively to the first connecting portions 310 or the second connecting portions 320. When the size of the pillow intended to be covered by the cover for cushion varies, the strap 330 and the buckles 340 allow easier adjustment of the cover for cushion to an appropriate size by tightening or loosening. In this case, the strap 330 and the buckles 340 may be incorporated into the horizontal edge portions 220, the vertical edge portions 210, the first connecting portions 310, or the second connecting portions 320, and insertion holes may be formed therein to enable the buckles 340 to protrude outwardly. Examples related to this structure are illustrated in FIGS. 15 and 16.

Figure 15:
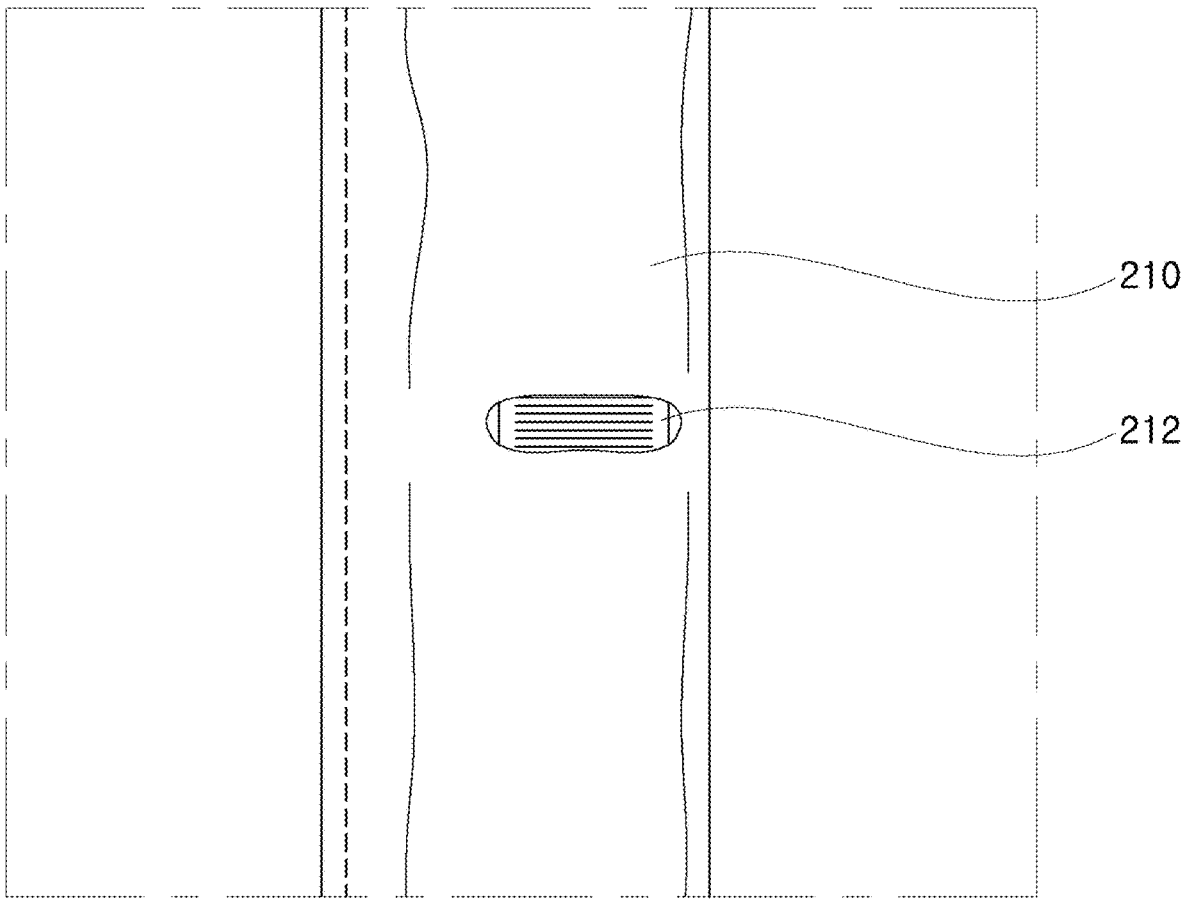
FIGS. 15 to 18 are photographs illustrating examples in which straps and buckles are incorporated into the vertical edge portions of the cover for cushions according to embodiments of the present invention.
Figure 16:
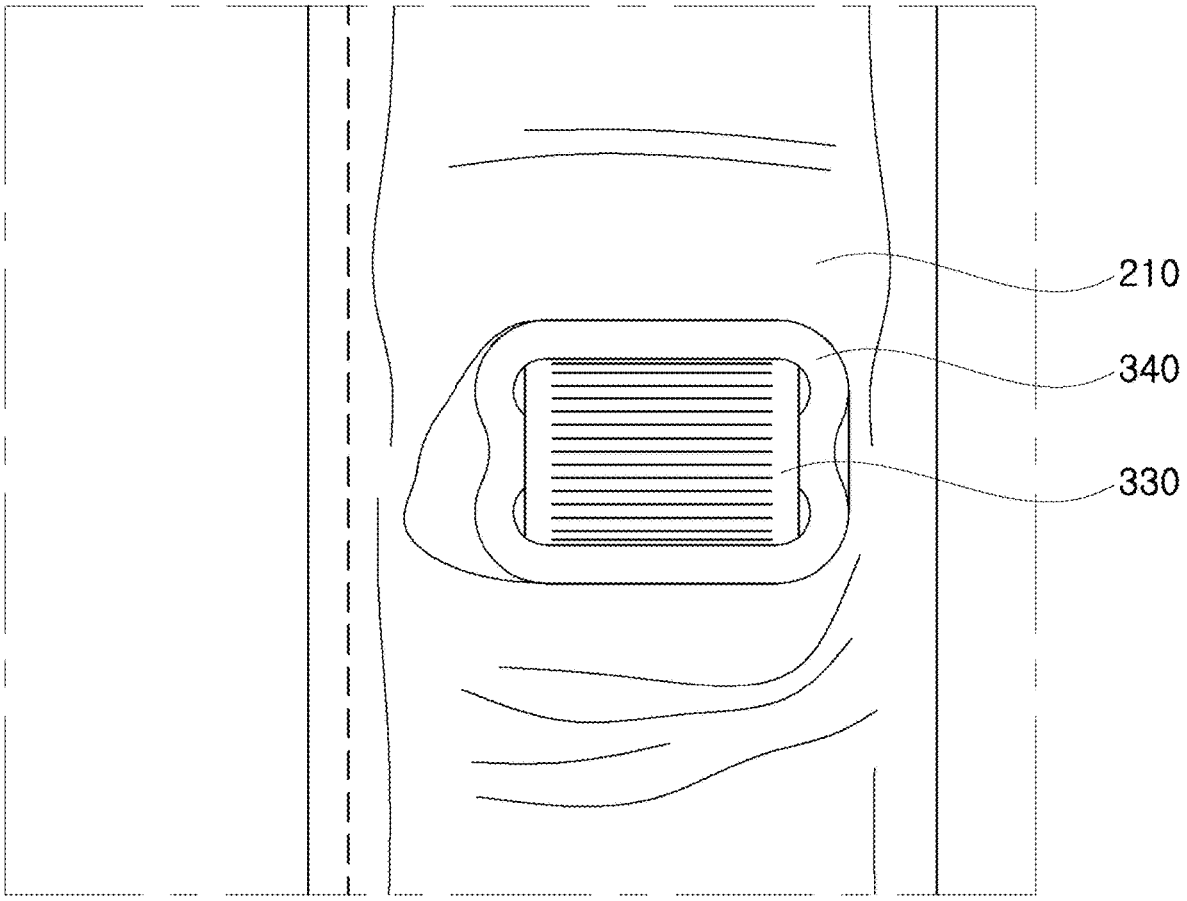

FIGS. 15 and 16 illustrate an example wherein the strap 330 and the buckles 340 are incorporated into the vertical edge portions 210 of the cover for cushion, and an insertion hole 212 is formed by cutting. FIG. 15 shows the buckles 340 inserted inside the insertion hole 212, while FIG. 16 shows the buckles 340 exposed outside through the insertion hole 212. When size adjustment of the vertical edge portions 210 is necessary, the buckles 340 and a portion of the strap 330 connected thereto are exposed externally through the insertion hole 212 to adjust the length of the strap 330. After adjusting the length of the strap 330, the strap 330 and the buckles 340 may be inserted into the vertical edge portions 210 through the insertion hole 212, thereby neatly arranging the external appearance. Although not illustrated in the drawings, the structure incorporating the strap 330 and the buckles 340 and forming the insertion hole, as described above, may similarly be applied to the horizontal edge portions 220, the first connecting portions 310, or the second connecting portions 320.

Figure 17:
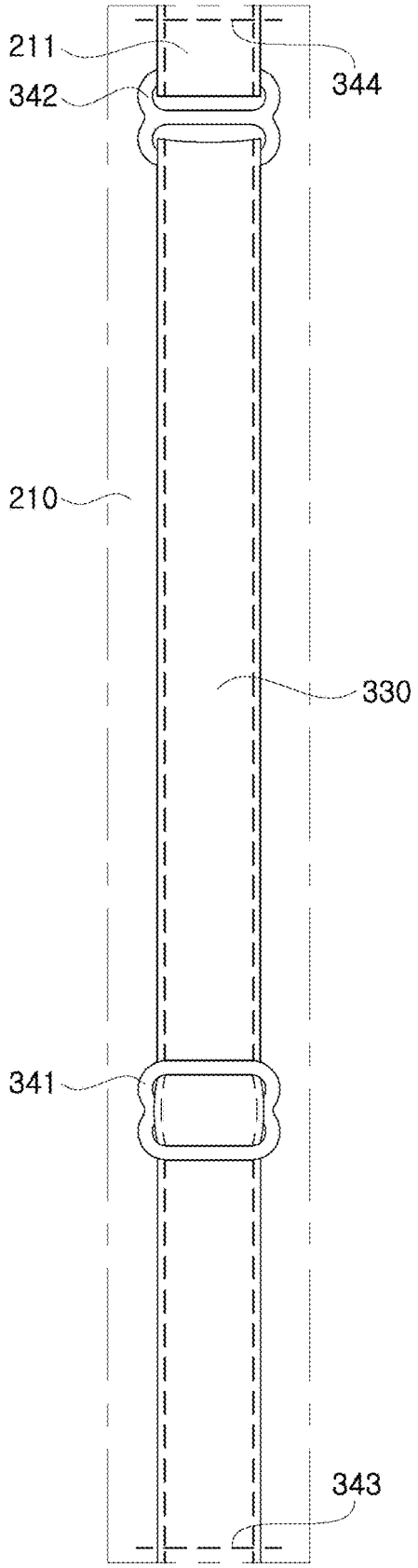
Figure 18:
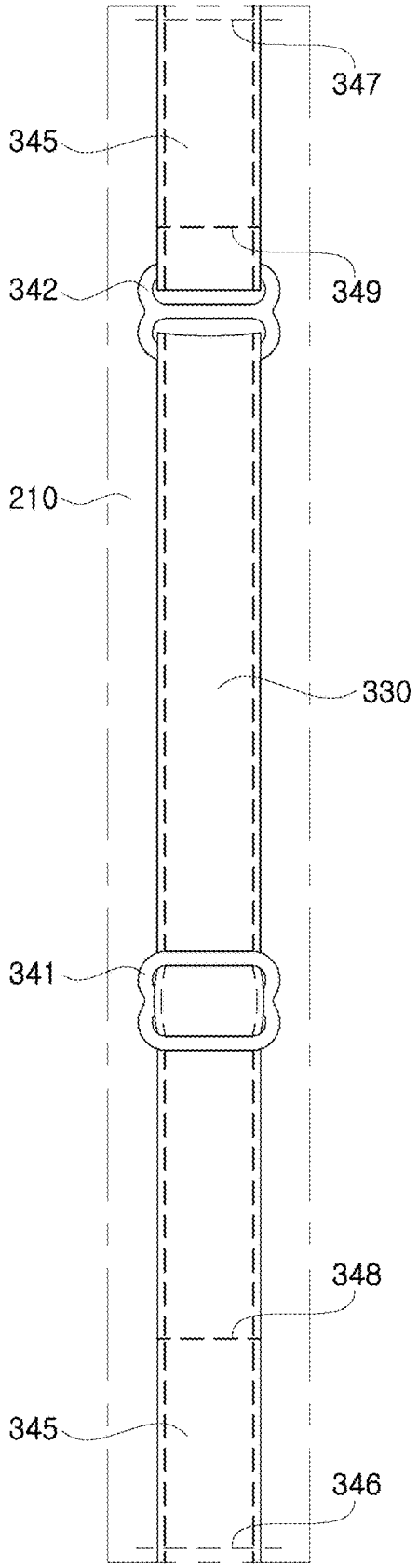

FIGS. 17 and 18 illustrate examples of the strap 330 and the buckles 340 incorporated into the vertical edge portions 210 as described with reference to FIGS. 15 and 16.

In one example, as illustrated in FIG. 17, when the strap 330 is inserted into the vertical edge portions 210, one end of the strap 330 (lower end in the figure) is sewn inside the vertical edge portions 210 by a first stitch line 343. At this time, the loop portion 211 is sewn by a second stitch line 344 on the opposite side of the first stitch line 343 of the vertical edge portions 210, with the strap 330 positioned therebetween, and the second buckle 342 at the other end of the strap 330 (upper end in the figure) is coupled to the loop portion 211. Such a connecting structure of the strap 330 may be employed when the strap 330 is non-elastic, slightly elastic, or made of elastic material.

In another example, as illustrated in FIG. 18, a pair of elastic bands 345 spaced apart at a predetermined distance may be respectively sewn into the vertical edge portions 210 by a third stitch line 346 and a fourth stitch line 347. In this configuration, one of the elastic bands 345 is sewn to one end (lower end in the figure) of the strap 330 by a fifth stitch line 348. The other elastic band 345 is coupled to the second buckle 342 at the opposite end of the strap 330. For this coupling, the elastic band 345 is folded into two layers and sewn by a sixth stitch line 349 to form a loop at the end thereof. Such a connecting structure of the strap 330 may be employed when the strap 330 is non-elastic or slightly elastic.

While the embodiments of the present disclosure have been described above, it will be appreciated by those skilled in the art that various modifications and changes can be made to the present disclosure without departing from the spirit and scope of the claims of the present disclosure.

INDUSTRIAL APPLICABILITY

The cover for cushion of the present invention can be easily coupled to and separated from a cushion, and when coupled, securely wraps around the four corners of the cushion, thereby preventing unintended separation of the cushion and the cover during use. In addition, the cover for cushion can be adjusted in size to fit the cushion without deforming the shape thereof. Furthermore, the cover for cushion prevents damage to other laundry items caused by hooks during washing.

The invention claimed is:

1. A cover for cushion, comprising:

a body portion having a predetermined area;

a pair of vertical edge portions formed along left and right edges of the body portion, respectively;

a pair of horizontal edge portions formed along upper and lower edges of the body portion, respectively; and a pair of connecting portions formed to mutually connect both ends of the vertical edge portions, respectively, wherein the connecting portions comprise a pair of first connecting portions respectively formed to extend from upper ends of the vertical edge portions, and a pair of second connecting portions respectively formed to extend from lower ends of the vertical edge portions and correspondingly coupled to the first connecting portions, and the first connecting portions and the second connecting portions are mutually coupled by coupling members, the first connecting portions and the second connecting portions are respectively formed at portions where the vertical edge portions meet the horizontal edge portions, and the vertical edge portions form curved shapes bulging outwardly from the body portion, when the first connecting portions and the second connecting portions are coupled, each portion of upper and lower ends of the body portion is folded, upper and lower ends of the vertical edge portions are folded inwardly toward the body portion at a predetermined angle, and the first connecting portions and the second connecting portions are disposed inwardly spaced apart from the vertical edge portions by a predetermined distance.

2. The cover for cushion according to claim 1, wherein the coupling members comprise buttons, Velcro tapes, or snap buttons.

3. The cover for cushion according to claim 1, wherein elastic bands are inserted into at least one of the vertical edge portions and the horizontal edge portions.

4. The cover for cushion according to claim 1, wherein strings configured by connecting elastic bands and cords are inserted into at least one of the vertical edge portions and the horizontal edge portions, wherein the string comprises a cord at a middle portion thereof, and elastic bands are respectively connected to both ends of the cord.

5. The cover for cushion according to claim 1, wherein a strap with length-adjustable buckles having loop holes is incorporated into at least one of the vertical edge portions, the horizontal edge portions, the first connecting portions, and the second connecting portions, and at least one of the vertical edge portions, the horizontal edge portions, the first connecting portions, and the second connecting portions is provided with insertion holes formed by cutting, through which the buckles are inserted and withdrawn.

6. The cover for cushion according to claim 1, wherein the connecting portions comprise a strap extending from one of both ends of the vertical edge portions, the first buckle provided on the strap, and the second buckle coupled to a loop portion sewn at the other end of the vertical edge portions and connected with the strap, wherein the first buckle and the second buckle are formed to have a pair of loop holes on both sides of bodies thereof, thereby allowing adjustment of a length of the strap.

7. The cover for cushion according to claim 1, wherein the first connecting portions and the second connecting portions are composed of cords capable of being mutually tied in form of a knot, and the coupling members comprise cord length adjusters configured to allow adjustment of lengths of the cords.

8. The cover for cushion according to claim 1, wherein the coupling members comprise one or more hook holes formed along a longitudinal direction of the first connecting portions at predetermined intervals, and a hook provided on the second connecting portions configured to engage with the hook holes.

9. The cover for cushion according to claim 8, wherein the second connecting portions comprise a hook pocket formed at a position spaced apart from the hook by a predetermined distance on a surface on which the hook is exposed, wherein, when an end portion of the second connecting portions is folded so that the hook is retained within the hook pocket, the hook is prevented from being exposed.

10. The cover for cushion according to claim 1, further comprising a cushion position indicator formed on an inner side of the body portion to indicate a position where a cushion is to be placed.

11. A cover for cushion, comprising:

a body portion having a predetermined area;

a pair of vertical edge portions formed along left and right edges of the body portion, respectively;

a pair of horizontal edge portions formed along upper and lower edges of the body portion, respectively; and a pair of connecting portions formed to mutually connect both ends of the vertical edge portions, respectively, wherein the connecting portions comprise a pair of first connecting portions respectively formed to extend from upper ends of the vertical edge portions, and a pair of second connecting portions respectively formed to extend from lower ends of the vertical edge portions and correspondingly coupled to the first connecting portions, the first connecting portions and the second connecting portions are respectively formed at portions where the vertical edge portions meet the horizontal edge portions, and the vertical edge portions form curved shapes bulging outwardly from the body portion, when the first connecting portions and the second connecting portions are coupled, each portion of upper and lower ends of the body portion is folded, upper and lower ends of the vertical edge portions are folded inwardly toward the body portion at a predetermined angle, and the first connecting portions and the second connecting portions are disposed inwardly spaced apart from the vertical edge portions by a predetermined distance.

* * * * *